United States Patent [19]

Blair

[11] 3,985,255

[45] Oct. 12, 1976

[54] BOTTLE CAP

[76] Inventor: Richard L. Blair, 249 Mattson Ave., Los Gatos, Calif. 95030

[22] Filed: Oct. 10, 1975

[21] Appl. No.: 621,609

[52] U.S. Cl. ..... 215/254
[51] Int. Cl.[2] ..... B65D 41/52
[58] Field of Search ..... 215/253, 254, 256

[56] References Cited

UNITED STATES PATENTS

| | | | |
|---|---|---|---|
| 2,778,520 | 1/1957 | Hyde | 215/305 X |
| 3,301,426 | 1/1967 | Kavalus | 215/254 |
| 3,338,446 | 8/1967 | Faulstich | 215/256 X |
| 3,392,860 | 7/1968 | Faulstich | 215/254 |
| 3,392,862 | 7/1968 | Faulstich | 215/254 |
| 3,469,727 | 9/1969 | Acton | 215/256 X |
| 3,672,528 | 6/1972 | Faulstich | 215/256 |
| 3,866,783 | 2/1975 | Bullock | 215/254 |

FOREIGN PATENTS OR APPLICATIONS

| | | | |
|---|---|---|---|
| 1,357,554 | 6/1974 | United Kingdom | 215/253 |

*Primary Examiner*—Donald F. Norton

[57] ABSTRACT

It is common to dispense special waters in glass containers of a capacity of about 5 gallons. The neck of each bottle is sealed with a unique plastic cap which is readily displaced to permit dispensing of the bottle contents which can be readily replaced to seal water remaining in the bottle for further use.

3 Claims, 4 Drawing Figures

BOTTLE CAP

SUMMARY OF THE INVENTION

It is a feature of the present invention that a plastic cap is provided to seal the bottle neck which can be readily and easily removed. This is a feature of the present invention for with prior plastic bottle caps, it is very hard for older people to lift the opening tab because it fits too close to the bottle neck.

Another feature of the present invention is that the cap is so scored that the cap tears readily until it is in position for release from the bottle neck. The cap will, however, reform itself and thus can be used to reseal the bottle.

A further feature of the present invention is the provision of a plastic ring on the inside of the cap so that it seals it readily against the top of the bottle neck and slightly below the curve provided on the top of the bottle neck.

An additional feature of the present invention is that all scores in the cap are external of the cap, thus assuring that water will not leak out of the bottle when it is placed on a delivery truck in transit to a consumer.

DESCRIPTION OF THE PREFERRED EMBODIMENT

Figure 1:
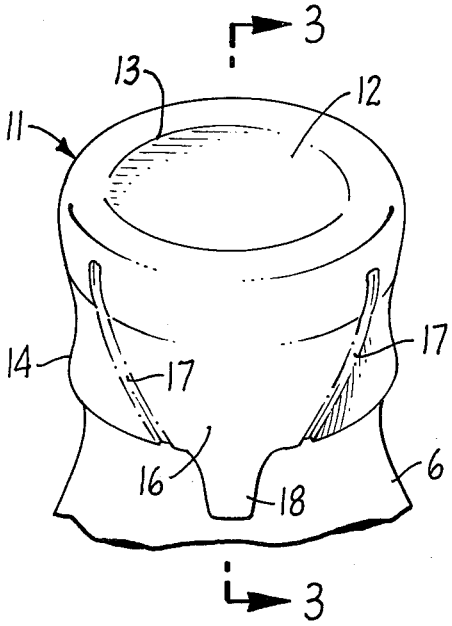
FIG. 1 is a perspective view of a bottle neck with a cap of the present invention in place.
Figure 2:
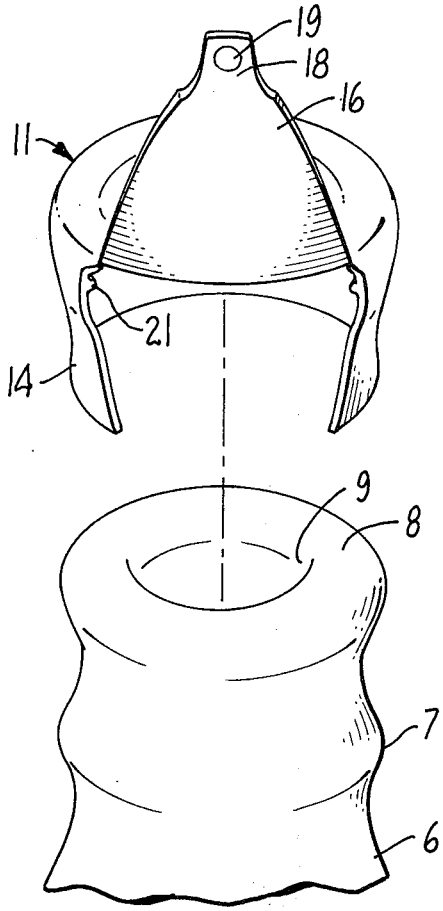
FIG. 2 is another perspective view showing a plastic cap embodying the present invention displaced from the bottle neck.

Referring to the drawings, the typical neck of a 5 gallon water bottle is indicated generally at 6. As is the usual practice, this has an annular ring 7 spaced from the top 8 of the bottle neck. The top 8 is curved inwardly as at 9.

Figure 3:
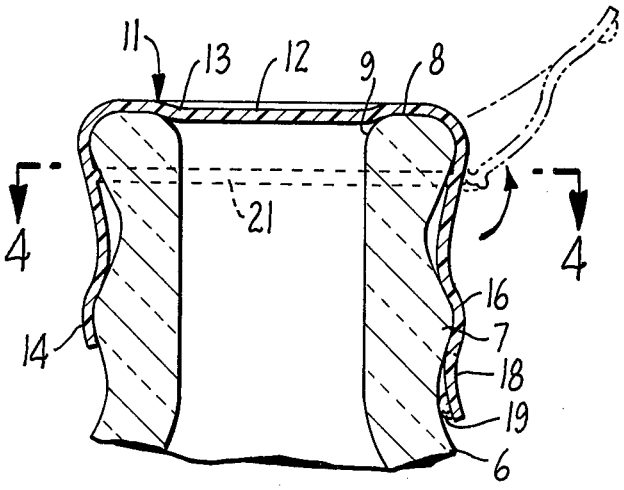
FIG. 3 is a section taken along the line 3—3 but illustrating how the cap can be released from the bottle neck.
Figure 4:
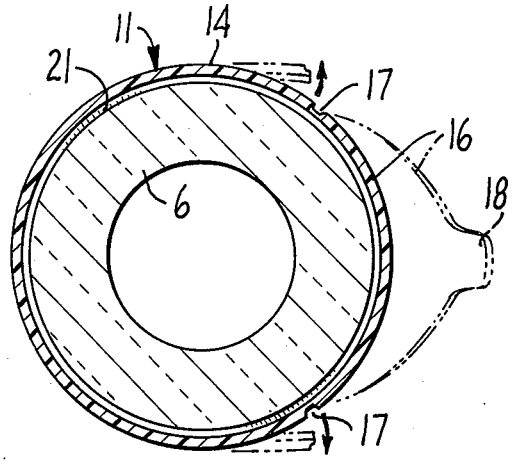
FIG. 4 is a section taken along the line 4—4 showing the relation of the cap and the external score lines.

In accordance with this invention, a plastic cap, generally at 11, is provided. This includes a top portion 12 having a depending annular ring 13 fitting within top 8 of the bottle. The cap 11 includes a depending skirt 14 which fits down over the annular ring 7. On one side of the cap I provide a depending portion, generally indicated at 16, which is integral with the cap 11 but has external score lines 17. By providing the score lines on the exterior of the cap, leakage from the bottle is prevented. Portion 16 includes a depending tab 18 which has a small button 19 which fits against the side of the bottle as appears in FIG. 3 to facilitate cap removal by preventing the tab from laying in too close to the bottle neck. The button also serves to position the cap in an automatic device used to apply a cap to a filled bottle. A sealing ring 21 is provided just below the upper portion of the cap to engage the side of the bottle.

While the cap has been shown on a bottle having an annular ring, it can also be used to close a bottle with screw threads on the neck. Use on a screw threaded bottle can be further facilitated by lengthening the skirt 14 by about three-eighths of an inch.

I claim:

1. In combination, a container having: a container neck having an annular end with a substantially circular arcuate upper corner and a downward tapering lower curvature ending in a minimum diameter portion, an annular ring below said minimum diameter portion; and a cap of a flexible plastic material deformable to accommodate minor variations in bottle dimensions and to permit said cap to stretch over said minimum diameter portion, said cap being preformed and having substantially uniform wall thickness throughout, said cap comprising a flat top disc having a diameter about equal to that of said neck, a depending skirt extending below said minimum diameter portion, and a depending tab connected to said skirt to extend below said skirt, said skirt being weakened by a pair of score lines which are located on the outside surface of said skirt to prevent leakage from the bottle, said score lines being positioned on opposite sides of said tab and extending upwardly toward said flat top disc and diverging outwardly from each other and terminating in the skirt just above said minimum diameter portion, said skirt being tearable along said score lines to open said cap, said cap in position on said neck sealing said neck against either input or output of liquid, said cap when torn along said score lines permitting removal of said cap from said neck and ready replacement thereof on said neck to reseal said bottle.

2. The combination of claim 1 wherein the tab has a button at its lower end spacing the tab slightly from the bottle neck.

3. The combination of claim 1 wherein an annular sealing ring is provided on the inside of the cap to engage the bottle neck just above the minimum diameter portion.

* * * * *